US005111177A

United States Patent [19]

Krueger et al.

[11] Patent Number: 5,111,177

[45] Date of Patent: May 5, 1992

[54] OVERLOAD CONDITION INDICATING FUSE

[75] Inventors: David J. Krueger, Arlington Heights; Siebang Oh, Elk Grove Village; Lun K. Tjhie, Prospect Heights, all of Ill.

[73] Assignee: Littlefuse, Inc., Des Plaines, Ill.

[21] Appl. No.: 587,809

[22] Filed: Sep. 25, 1990

Related U.S. Application Data

[63] Continuation-in-part of Ser. No. 412,914, Sep. 26, 1989.

[51] Int. Cl.[5] ..... H01H 85/30

[52] U.S. Cl. ..... 337/243; 337/241; 337/265

[58] Field of Search ..... 337/243, 241, 265

[56] References Cited

U.S. PATENT DOCUMENTS 1,875,019 5/1932 Hassell et al. .

4,603,315 7/1986 Leong et al. ..... 337/243

*Primary Examiner*—Harold Broome

*Attorney, Agent, or Firm*—Wallenstein, Wagner & Hattis, Ltd.

[57] ABSTRACT

A fuse is provided which has a fuse housing with a transparent portion thereof, and a fuse element extending through the housing which is coated with a preferably non-hazardous temperature-responsive material. The temperature conditions generated at the interface between the coating and the fuse element cause the coating to leave the fuse element and deposit upon this transparent portion of the housing. The temperature-responsive coating on the fuse element will be transferred to the housing walls even where modest current overloads flow which do not immediately open the fuse. Different circuit overload conditions, including short circuit events, produce different visual indications or colorations on the transparent housings inside surfaces, which serves to identify the nature and degree of the overload problem existing in the circuit. Coatings, also capable of fluorescing under specific irradiation conditions, may be used.

8 Claims, 2 Drawing Sheets

OVERLOAD CONDITION INDICATING FUSE

RELATED APPLICATIONS

This application is a continuation-in-part of U.S. application Ser. No. 412,914 filed Sep. 26, 1989.

TECHNICAL FIELD

This invention relates to electrical fuses. While certain aspects of the invention have a broader application, the most important application is in cartridge-type fuses which have transparent, cylindrical housings generally enclosed by metal end caps, with the fuse element extending connected between the end caps.

BACKGROUND PRIOR ART

Cartridge-type fuses have been heretofore designed which provide an indication of an open fuse condition with the deposition of a visible coating on the inside surfaces of the transparent fuse housings. One such fuse is disclosed in U.S. Pat. No. 4,603,315, assigned to the owner of the present patent application. The fuse utilizes a two component pyrotechnic mixture which produces a colored smoke when ignited. Except for this patented fuse, prior art indicating fuses did not provide evidence of current overloads or transients which may not be of sufficient magnitude or duration to initiate operation of the fuse. This prior art patented fuse was not commercially produced because of manufacturing difficulties, cost considerations, and the hazardous nature of the pyrotechnic coating materials involved.

Indicating fuses have also been heretofore developed which provide by mechanical means an indication of an open fuse condition. The cost of manufacture of such fuses makes them impractical for use as replacements for commonly used low-cost fuses.

It would be highly advantageous to provide an economically manufacturable fuse from non-hazardous materials which would be capable of producing visual evidence of electrical loading conditions (1) sufficient to cause fuse element disruption, (2) approaching circuit overload levels for a significant time interval, and (3) exceeding overload conditions but for a time period insufficient to produce opening of the fuse. The occurrence of an indication from either of the latter circuit conditions would enable responsible parties to investigate the electrical equipment system, determine the source of the excessive current, and initiate corrective actions before possible nuisance service interruption or actual damage to circuit components might take place.

SUMMARY OF THE INVENTION

In accordance with one of the features of the invention, a fuse is provided which has a fuse housing with a transparent portion thereof, and a fuse element extending through the housing which is coated with a preferably non-hazardous temperature-responsive material. The temperature conditions generated at the interface between the coating and the fuse element cause the coating to leave the fuse element and deposit upon this transparent portion of the housing. Transfer of the coating on the fuse element to the transparent portion of the housing can take place by a process involving the evaporation of the coating material and its condensation/deposition on the cooler housing walls or, as in the instance of the preferred form of the invention, by the evolution of gases at the interface between the coating and the fuse wire or as by forces caused by the deflagration of a fuse wire fabricated from Pyrofuze material, both of which propel the coating material beyond this interface against the transparent portion of the housing.

In accordance with another aspect of the invention, the temperature-responsive coating on the fuse element will be transferred to the housing walls even where modest current overloads flow which do not immediately open the fuse, so that advanced notice is given that an abnormal current condition exists. Corrective action can then be initiated before the circuit interrupt condition develops. Also, in accordance with the preferred form of this invention, this coating responses to various electrical overload conditions sufficient to produce opening of the fuse are such that the material which deposits on the inner surface of the housing provides a substantially different visual indication when short circuit conditions prevail than when modest overload currents exist.

In accordance with still another aspect of the present invention, the abnormal indication providing material which is transferred to the housing walls under excessive current excursions and preferably also under modest overload conditions incorporates a material which fluoresces when subjected to light radiation of specific wavelengths as, for example, ultraviolet light. In such cases, the operating conditions of massive numbers of circuits by large numbers of fuses mounted on a fuse mounting panel can be conveniently checked by directing a light source of appropriate wavelength against the fuse mounting panel. Overloaded or abnormally operating circuits thus can be immediately pinpointed by the fuses which provide a glowing indication under exposure to that light source.

A still further aspect of the invention involves details of the preferred coating of the fuse element and the method of applying the same to the fuse wire.

Other advantages and aspects of the invention will become apparent upon making reference to the specification, claims, and drawings to follow.

DETAILED DESCRIPTION OF THE INVENTION

Figure 1:
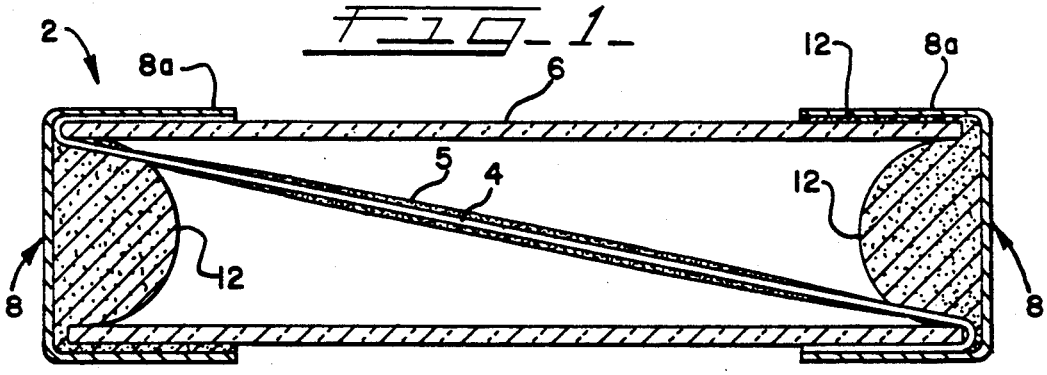
FIG. 1 is an enlarged, longitudinal sectional view through a cartridge fuse having a fast acting common-type fuse wire extending diagonally across the fuse housing and having a unique coating thereon which, when under the influence of various high current conditions ranging from modest overloads to actual short circuit values, produces different visible indications of such events by transferring the coating material from the fuse wire to the inside surface of the transparent fuse housing.

FIG. 1 shows a longitudinal sectional view through a conventionally constructed cartridge fuse 2, except that the fuse element 4 thereof has a unique coating 5 thereon which provides the unique indications of the invention. This coating, preferably non-hazardous, can be effectively applied to any fuse element and once applied, will exhibit excellent stability throughout the life of the fuse.

In the particular cartridge fuse construction illustrated, the fuse element extends diagonally across the interior of a transparent fuse housing 6. The fuse wire 4 bends around the opposite ends of the housing where it is sandwiched between the housing and the cylindrical skirts 8*a*—8*a* of cup-shaped metal end caps 8—8 applied over the open ends of the housing 6. The ends of the fuse wire 4 are physically and electrically connected to the metal end caps by bodies of solder 12—12 in a conventional way. The solder can be intermixed with an adhesive material which adheres the end caps to the housing 6. The end caps illustrated are leadless and thus are designed to be mounted in conventional, spring metal terminals or directly soldered to terminals on a printed circuit board (referred to as surface mounting the fuse). In the alternative, the end caps can be provided with leads which can be soldered into a printed circuit board or the like. In the latter case, the strength of the fuse can be reinforced by the application of transparent shrink tubing or a transparent encapsulation material which extends around the ends of the end caps to seal and increase the strength of the fuse.

For the most effective use of the present invention, the inner wall surfaces of the fuse housing 6 should be cleaned with a suitable solvent, so that no materials are present which would interfere with the effective deposition of the fuse condition indicating material originating from the coating 5 to be deposited thereon. The fuse element coating 5 is most advantageously applied over substantially the entire length of that portion of the fuse wire 4 which extends opposite the visible portions of the housing 6. As indicated, the end portions of the housing are covered by the skirts 8*a*—8*a* of the end caps 8—8.

The coating 5, in the most preferred form of the invention, is a material which reacts to the temperature conditions existing at the interface between the fuse element 4 and the coating 5, produced by what will be referred to as a modest overload current which does not, if ever, open the fuse, by partially leaving the fuse wire and depositing upon the walls of the fuse housing to produce a fuse indication of one color or appearance. When a short circuit or highly excessive overload current flows in the fuse wire which immediately blows the fuse, the coating will deposit upon the walls of the housing to produce a different color or indication.

This transfer of the coating to the inner surface of the fuse housing can take place in a number of different ways. The coating can be of a type which partially or completely vaporizes under those temperature conditions and then condenses and deposits on the cooler inner surface of the housing. In accordance with a preferred form of the invention, this transfer takes place by the decomposition of the coating material only at the interface of the coating and wire, the gaseous decomposition products formed then propelling the remaining coating material which surrounded the decomposition zone against the inner surface of the fuse housing. As a modest overload current continues to flow through the fuse wire, greater portions along its length attain temperatures sufficient to initiate decomposition of the contacting coating at its surface and additional material thus becomes capable of being transferred. The current conditions prevailing during a particular overload event obviously establish the temperature profile along the wire at any given time and thereby fix the rate and quantity of material transfer and the resultant indication characteristic.

Figure 4:
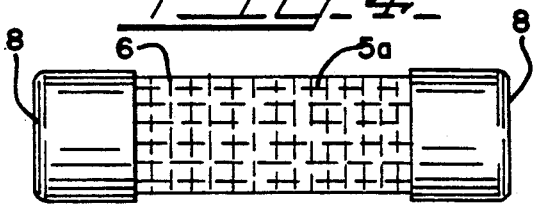
FIG. 4 is a side, elevational view of the fuse showing by appropriate color-indicating shading the coating on the fuse housing which indicates that a modest overload current has flowed in the fuse.

FIG. 4 illustrates the appearance of the fuse under modest overload current conditions. In such cases, the initially colorless, transparent material of the fuse housing has received a colored coating thereon indicated by the color-indicating shading 5*a* in FIG. 4. In one exemplary form of the invention, as the non-opening current overload increases in value or flows for a longer period of time, this color shifts from a pale yellow to deeper yellow with reddish overtones. If the fuse should ultimately open under these modest current overloads which do not instantaneously open the fuse, the indication will remain as the deeper yellow version of the basic non-opening overload current condition. Visual inspection of the fuse would thus provide information regarding the magnitude of the circuit overload conditions which prevailed in the circuits involved.

Figure 3:
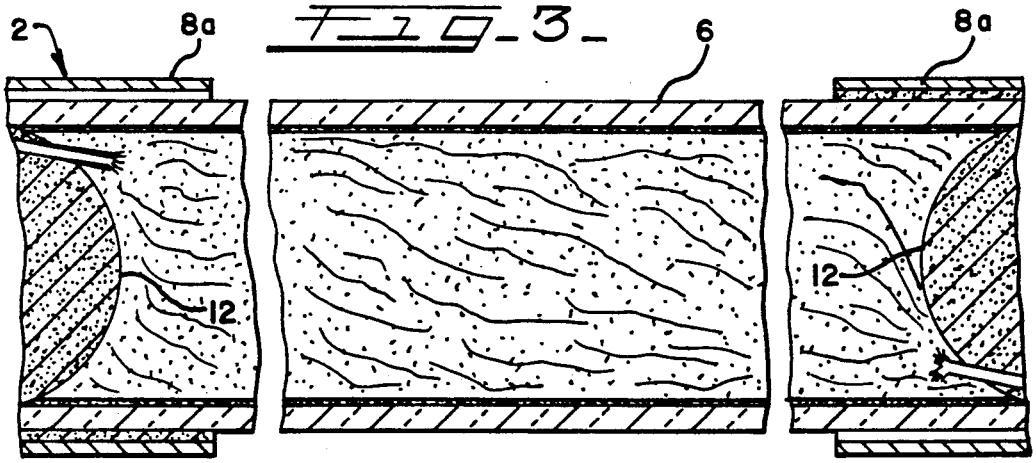
FIG. 3 is an enlarged, fragmentary longitudinal sectional view of the fuse of FIG. 1 when a short circuit current has immediately blown the fuse.
Figure 5:
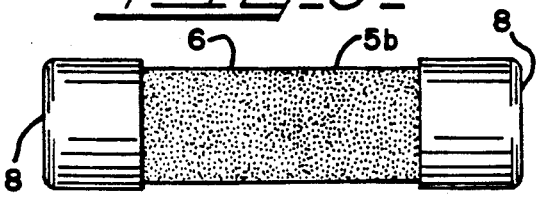
FIG. 5 is a side, elevational view of the fuse shown in FIG. 4, which shows a differently colored coating produced by a short circuit condition which has opened the fuse.

Under short circuit conditions which immediately open the fuse wire, the fuse wire melts, vaporizes, oxidizes and condenses on the housing inside surfaces as a blackish appearing deposit 5*b* hereon, as shown in FIGS. 3 and 5. To the extent that the coating material also deposits on the housing wall, the black color of the fuse wire deposit overshadows the deposited coating color, so that the resultant coating is still substantially black.

Another desired characteristic of the fuse element coating 5 is that it includes a fluorescent material which deposits upon the inner surface of the fuse housing 6. As previously indicated, this provides the advantage that large numbers of circuits protected by fuses of the present invention can be quickly evaluated by inspection of such fuses under ultraviolet or other radiation and abnormally high operating current conditions can be readily identified before equipment damage might occur. Fluorescence of the material coating on any given fuse housing would be evidenced as a glowing condition under the radiation exposure, and would serve to identify those circuits which had been through a substantial electrical overload excursion.

As previously indicated, the coating 5 could comprise any one of a number of different materials. In accordance with a preferred form of the invention, the basic coating material is a temperature-sensitive substance manufactured by the Tempil Division of Big Three Industries, Inc., of South Plainfield, N.J. This material, having the trademark "Tempilaq", is sold under a variety of compositions/specifications to provide coatings which exhibit melting characteristics indicative of a particular temperature level or excursion. One Tempilaq coating found useful is that sold under the Tempilaq composition indicated to operate at 625° F.

This Tempilaq material includes a fluorescein pigment or dye dispersed in a volatile solvent. This Tempilaq material is then mixed with an adhesive material-mix and Xylene. An example of the adhesive material is 40% Xylene (specification No. 1330-20-7) and 60% Polymethylphenyl silicone resin (specification No. 63148-52-7). The Xylene silicone resin can be ordered from the Rhone-Poulenc, Inc. of New Brunswick, N.J. There is added to this 40–60% mixture an additional quantity of Xylene to make the Xylene to silicone resin ratio about 86%.

The exemplary mixture of this Tempilaq material and the silicone-Xylene solution is 50% by weight of Tempilaq and 50% by weight of the Xylene solution of silicone.

By way of example only, this mixture was applied over a 20% silver clad copper fuse wire of approximately 0.0034" in diameter and allowed to air dry. The coating thickness was approximately 0.0005". The coated wire was then baked in an oven heated to a temperature of 400 degrees Fahrenheit for 30 minutes. That heat treatment served to enhance distribution of the silicone constituent within the coating and thereby improved the coating adherence to the underlying wire.

When this fuse wire was placed in a fuse housing with end caps as illustrated in FIG. 1, and subjected to a 135% current overload for one minute, a pale yellow deposit appeared on the inner surface of the fuse housing. In the case of a simple fuse wire as identified in FIG. 1 subjected to a 500% overload which immediately opened the fuse, the color was reddish brown, although it was blackish under short circuit current. In the case where the fuse element was a slow acting fuse comprising a coil of fuse wire around a material as described in U.S. Pat. No. 4,445,106, the color produced by such a 500% overload was a brownish black color, because of the different conditions produced when this level of current flowed in such a different fuse element configuration.

Figure 2:
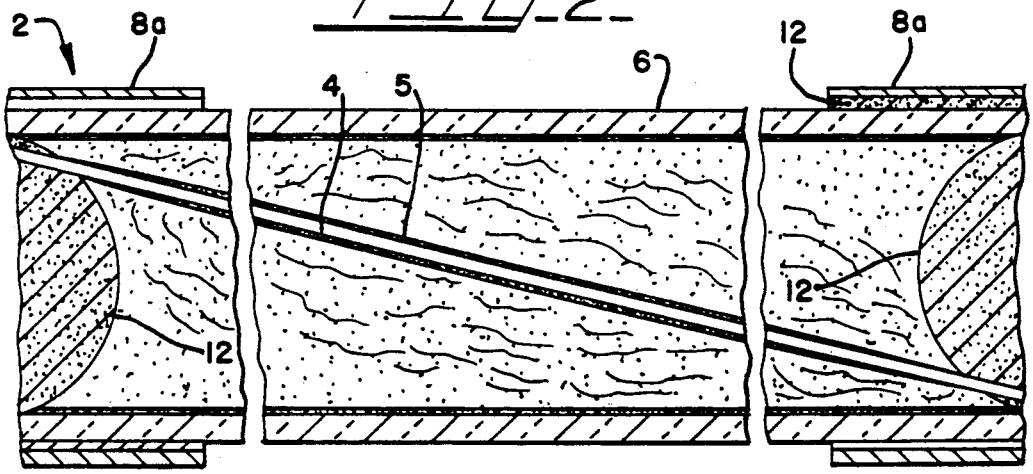
FIG. 2 is an enlarged, fragmentary longitudinal sectional view of the fuse of FIG. 1 when a non-opening, but high current flows through the fuse wire, the coating being partially deposited on the inner surface of the fuse housing where it is visible to an observer of the fuse.

The exemplary preferred fuse element 4' coated and heat treated as described is assembled in the fuse housing 6 with the end caps 8—8 applied thereto in a conventional way. This assembly process includes the sequential assembly of each end cap 8 over an end of the fuse housing 6 and the melting of a solder pellet by heating the end cap to melt the pellet momentarily. The heat generated in this process is found to melt only that portion of the coating of the wire adjacent to the end caps. This is the reason why the thickness of the coating tapers off to nothing at the ends of the fuse element 4 shown in FIGS. 1 and 2.

Figure 6:
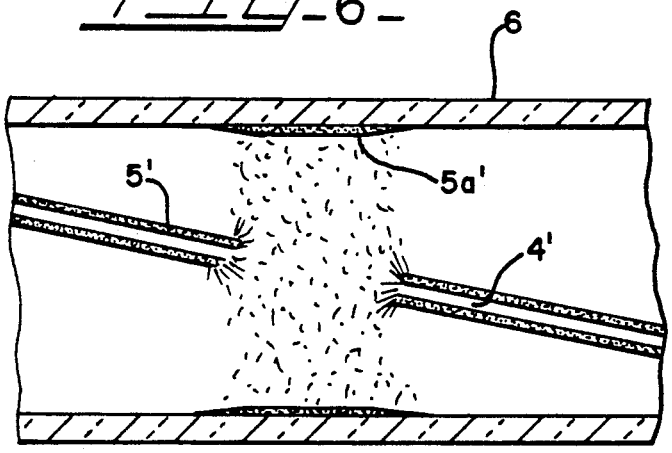
FIG. 6 is a sectional view through a modified fuse which is similar to the fuse shown in FIG. 1, except that the coated fuse filament is manufactured from a special composite material known as Pyrofuze, which, when subjected to current passage of sufficient magnitude, reaches a temperature wherein rapid deflagration of the wire takes place without oxygen, the Figure showing the coating on the partially reacted wire being propelled against the wall of the fuse housing opposite thereto.
Figure 7:
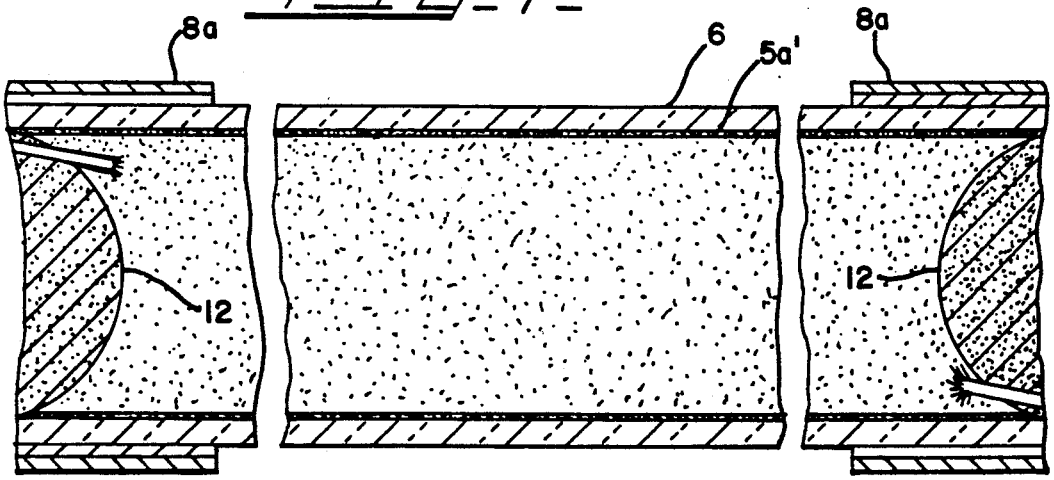
FIG. 7 shows the fuse of FIG. 6 when the entire length of fuse wire has been consumed so that the liberated and transferred coating extends the entire length of the fuse housing.

While the form of the invention just described is the preferred form thereof, reference should now be made to FIGS. 6 and 7 for a modified but less preferred form of the invention. This embodiment of the invention illustrates the broader aspects of the present invention applicable to a fuse which can provide only a single indication of fuse element disruption due to excessive current overloading, whereas the preferred form produces a distinguishing indication under modest, non-opening overload current conditions as well.

In FIGS. 6 and 7, the fuse illustrated is substantially the same as illustrated in FIG. 1, except that the fuse element material 4', instead of being a conventional fusing alloy, consists of a more exotic composite combination of metallic elements that exhibit unique properties when heated sufficiently as would be the situation under the influence of high current passage through wires fabricated from that material. The specific wire material referenced is that sold by the Pyrofuze Corp. under the trade name Pyrofuze. It consists of a #5056 aluminum alloy core surrounded by a Palladium 5%-Ruthenium alloy jacket. Overload current passage through fuses containing Pyrofuze wire elements raises their temperature to that level where rapid alloying of the components takes place, and instant deflagration and boiling of the wire constituents occurs without the presence of oxygen. When this reaction has been triggered at the mid-length of the fusing element, it rapidly progresses along the wire in both directions until reaching the opposing fuse end caps, 8—8. As the described metallurgical reactions take place, the boiling and vaporizing products formed act to propel the coating, 5' applied to the entire length of the wire against the inner surface of the housing 6, as best shown in FIG. 7.

In this form of the invention, where only electrical overload conditions exist that produce disruption of the element wire, the coating 5' can be any suitable colored material which is blown against the inner surface of the fuse housing. The coating 5' could also be the same coating 5 utilized in the previous form of the invention, shown in FIGS. 1–5.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

We claim:

1. A condition indicating fuse comprising: a housing having at least one transparent section; a pair of spaced terminals exposed on said housing for connection to an external circuit; a fuse element extending between said terminals in said housing, said fuse element melting to interrupt the circuit between said terminals immediately upon flow of short circuit currents or after various progressively decreasing periods of time upon the flow of progressively increasing levels of overload current; and fuse condition indicating means in said housing responsive to a current overload in the fuse element by depositing on the inner surface of said housing a material which fluoresces upon being subjected to external radiation to enable identification of said fuses that have been exposed to abnormally high current levels in their application, said fuse element indicating means including an overload condition indicating material which, upon the flow of said overload current, is blown against the inner surface of the housing.

2. The fuse of claim 1 wherein said material deposits said coating on the inner surface of said housing when said overload current is of insufficient value to open the fuse, as well as when it is of sufficient value to open the fuse element.

3. A condition indicating fuse comprising: a housing having at least one transparent section; a pair of spaced terminals exposed on said housing for connection to an external circuit; a fuse element extending between said terminals in said housing, said fuse element melting to interrupt the circuit between said terminals immediately upon flow of short circuit currents or after various progressively decreasing periods of time upon the flow of progressively increasing levels of overload current; an overload condition indicating material initially in said housing and which when deposited on said transparent section of said housing presents a visible coating indicating that the fuse has been subjected to abnormally high current levels; and means responsive to a current-overload condition for depositing said overload condition indicating material on said transparent section of the housing.

4. The fuse of claim 1 or 3 wherein said overload condition-indicating material is a coating deposited on said fuse element and includes a material other than said overload condition indicating material responsive to said heat at the interface between said coating and the fuse element by decomposing thereat and generating gases which force the overload condition indicating material therebeyond against the transparent inner surface of said housing.

5. The fuse of claim 3 wherein said overload condition indicating material produces a fluorescent coating on the inner surface of said fuse housing.

6. The fuse of claim 1 or 3 wherein said material is a coating on said fuse element and includes a dye-containing material mixed with an adhesive material which adheres said die-containing material to the surface of said fuse element.

7. The fuse of claims 1, 2 or 5 wherein said overload condition indicating material includes a fluorescein dye.

8. The fuse of claims 1, 2, 3, or 5 wherein said material is a coating applied to the fuse element and includes a color-producing material intermixed with an adhesive material which adheres the color-producing material to the fuse element.

* * * * *

UNITED STATES PATENT AND TRADEMARK OFFICE

CERTIFICATE OF CORRECTION

PATENT NO. : 5,111,177

DATED : May 5, 1992

INVENTOR(S) : Krueger et al.

It is certified that error appears in the above-indentified patent and that said Letters Patent is hereby corrected as shown below:

On the title page, Assignee, delete "Littlefuse" and insert --Littelfuse--.

Signed and Sealed this

Second Day of July, 1996

Bruce Lehman

*Attest:*

BRUCE LEHMAN

*Attesting Officer*

*Commissioner of Patents and Trademarks*